US007958578B2

(12) United States Patent
Shan et al.

(10) Patent No.: US 7,958,578 B2
(45) Date of Patent: Jun. 14, 2011

(54) PLAY YARD

(75) Inventors: Lin-Hai Shan, Taipei (TW); Hong-Bin Xu, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 294 days.

(21) Appl. No.: 12/320,374

(22) Filed: Jan. 26, 2009

(65) Prior Publication Data

US 2009/0188039 A1 Jul. 30, 2009

Related U.S. Application Data

(60) Provisional application No. 61/006,727, filed on Jan. 29, 2008.

(51) Int. Cl.
*A47D 7/00* (2006.01)
*A47D 13/06* (2006.01)
*A47D 5/00* (2006.01)

(52) U.S. Cl. ..... 5/93.1; 5/93.2; 5/99.1; 5/655

(58) Field of Classification Search ..... 5/93.1, 5/93.2, 97, 98.1, 99.1, 655, 503.1, 507.1, 5/658

See application file for complete search history.

(56) References Cited

U.S. PATENT DOCUMENTS 2,553,087 A * 5/1951 Hanson ..... 5/93.1
3,848,277 A * 11/1974 Reguitti ..... 5/11
5,553,336 A * 9/1996 Mariol ..... 5/93.1
5,918,329 A * 7/1999 Huang ..... 5/93.1
5,956,786 A * 9/1999 Huang ..... 5/105
5,991,944 A * 11/1999 Yang ..... 5/99.1
6,026,524 A * 2/2000 Barger ..... 5/93.1
6,158,067 A * 12/2000 Cheng ..... 5/106
6,192,535 B1 * 2/2001 Warner et al. ..... 5/93.1
6,233,759 B1 * 5/2001 Warner et al. ..... 5/99.1
6,418,575 B1 * 7/2002 Cheng ..... 5/93.1
6,430,762 B1 * 8/2002 Cheng ..... 5/93.2
6,543,070 B2 * 4/2003 Longenecker et al. ..... 5/93.1
6,735,796 B2 * 5/2004 Warner et al. ..... 5/99.1
6,948,197 B1 * 9/2005 Chen ..... 5/93.1
7,581,269 B2 * 9/2009 Chen et al. ..... 5/655
2001/0001161 A1 * 5/2001 Warner et al. ..... 5/99.1
2001/0001162 A1 * 5/2001 Warner et al. ..... 5/99.1
2001/0001330 A1 * 5/2001 Warner et al. ..... 5/99.1
2002/0078499 A1 * 6/2002 Cheng ..... 5/95
2002/0166169 A1 * 11/2002 Longenecker et al. ..... 5/93.1
2008/0034506 A1 * 2/2008 Chen et al. ..... 5/655
2008/0098530 A1 * 5/2008 Chen et al. ..... 5/655
2009/0113624 A1 * 5/2009 Tuckey ..... 5/93.1
2009/0188039 A1 * 7/2009 Shan et al. ..... 5/93.1

* cited by examiner

*Primary Examiner* — Robert G Santos
(74) *Attorney, Agent, or Firm* — Davidson Berquist Jackson & Gowdey, LLP

(57) ABSTRACT

A play yard includes a first frame unit and a bassinet-supporting second frame unit. The first frame unit includes a plurality of spaced-apart upright rods, a plurality of corner couplers that are provided respectively on the upright rods, and a plurality of side rods, each interconnecting a pair of the corner couplers. The second frame unit includes a plurality of connecting rods, each having a supporting segment and a pair of bent end segments that are connected respectively to longitudinally opposite ends of the supporting segment, and that are connected movably and respectively to a pair of the corner couplers, such that each of the connecting rods is selectively positioned relative to the first frame unit at a lower position and a higher position located above the lower position.

14 Claims, 10 Drawing Sheets

PLAY YARD

CROSS-REFERENCE TO RELATED APPLICATION

This application claims priority of U.S. Provisional Application No. 61/006,727, filed on Jan. 29, 2008.

BACKGROUND OF THE INVENTION

1. Field of the Invention

The invention relates to a play yard, more particularly to a play yard adapted to be mounted with a height adjustable bassinet.

2. Description of the Related Art

A bassinet is generally mounted on a play yard at a position above the bottom of the play yard, such that the bassinet may serve as a changing table or a bed for babies. However, the bassinets are generally not height adjustable relative to the play yards on which they are mounted. Taiwanese Utility Model No. M250604 discloses a conventional play yard mounted with a height adjustable bassinet. However, the conventional play yard has a relatively complicated height adjustment mechanism for the bassinet, and the bassinet cannot be operated quickly for height adjustment during use.

SUMMARY OF THE INVENTION

Therefore, the object of the present invention is to provide a play yard adapted to be mounted with a height adjustable bassinet that is easy to use.

Accordingly, a play yard of the present invention comprises a first frame unit and a bassinet-supporting second frame unit. The first frame unit includes a plurality of spaced-apart upright rods, a plurality of corner couplers that are provided respectively on the upright rods, and a plurality of side rods, each interconnecting a pair of the corner couplers. The second frame unit includes a plurality of connecting rods, each having a supporting segment and a pair of bent end segments that are connected respectively to longitudinally opposite ends of the supporting segment, and that are connected movably and respectively to a pair of the corner couplers of the first frame unit, such that each of the connecting rods is selectively positioned relative to the first frame unit at a lower position and a higher position located above the lower position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
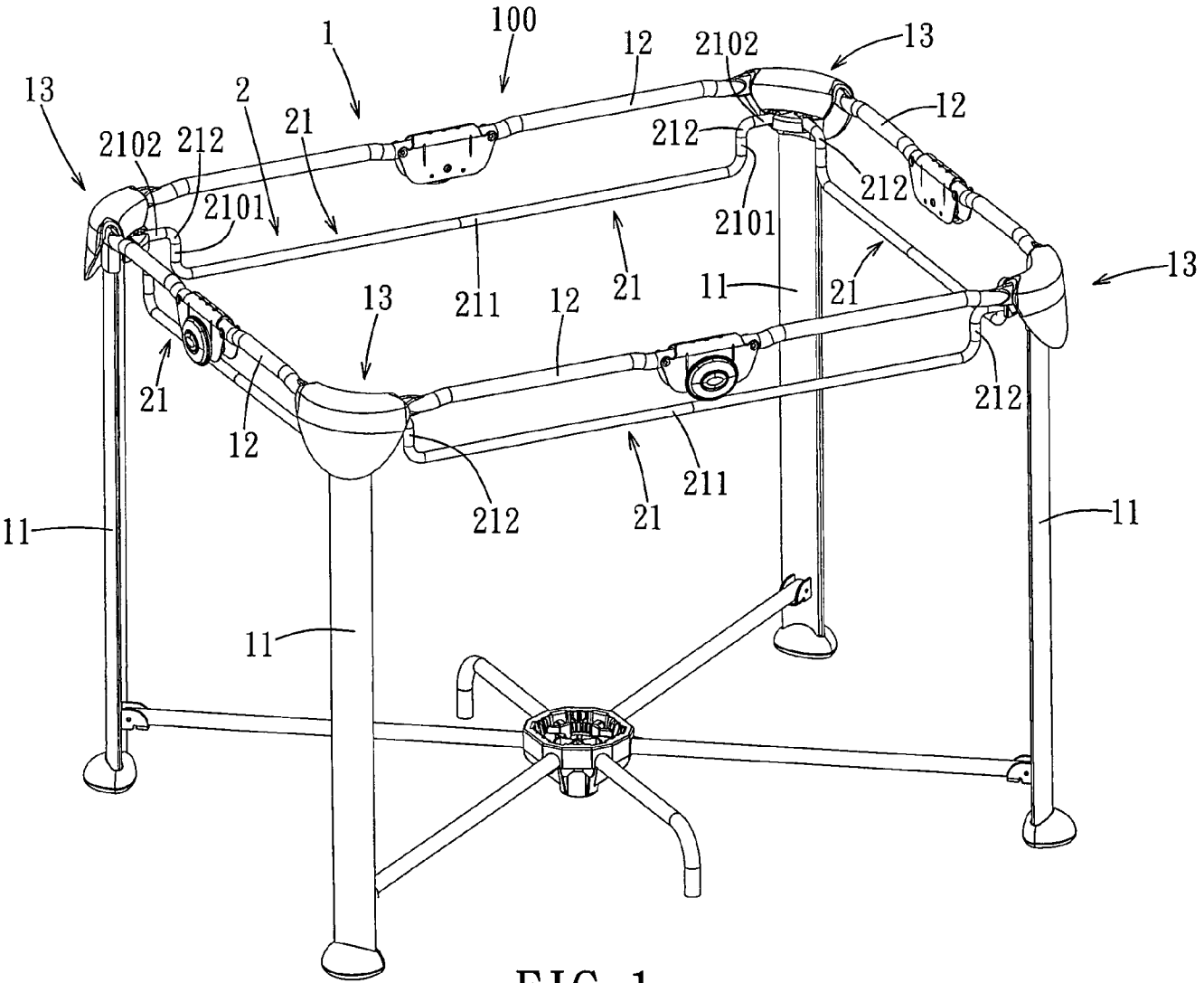
FIG. 1 is a perspective view of a first preferred embodiment of a play yard according to the invention, illustrating a bassinet-supporting second frame unit at a lower position.
Figure 2:
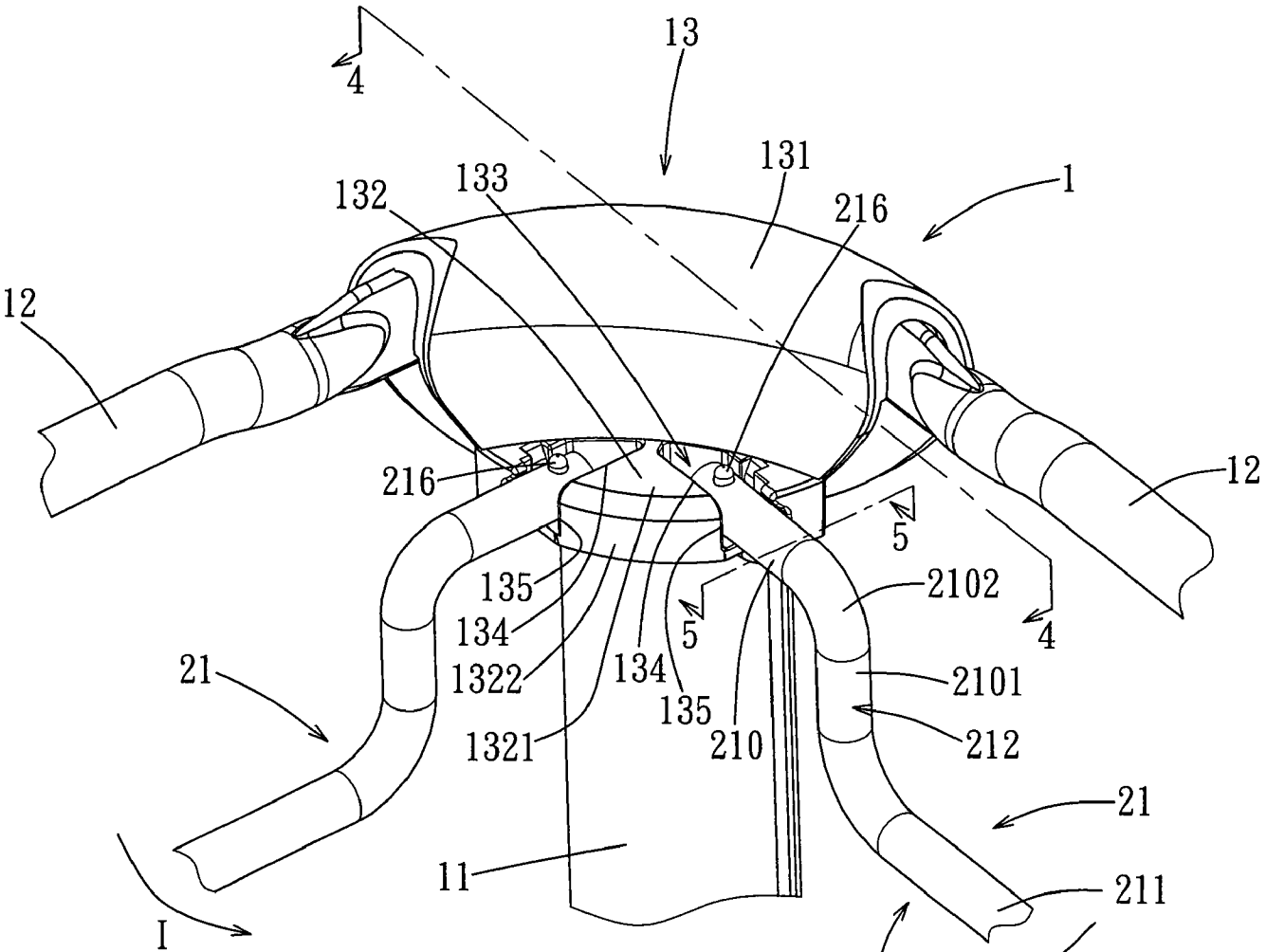
FIG. 2 is an enlarged fragmentary perspective view of the first preferred embodiment, illustrating a pair of connecting rods of the second frame unit coupled to a corner coupler of a first frame unit.
Figure 3:
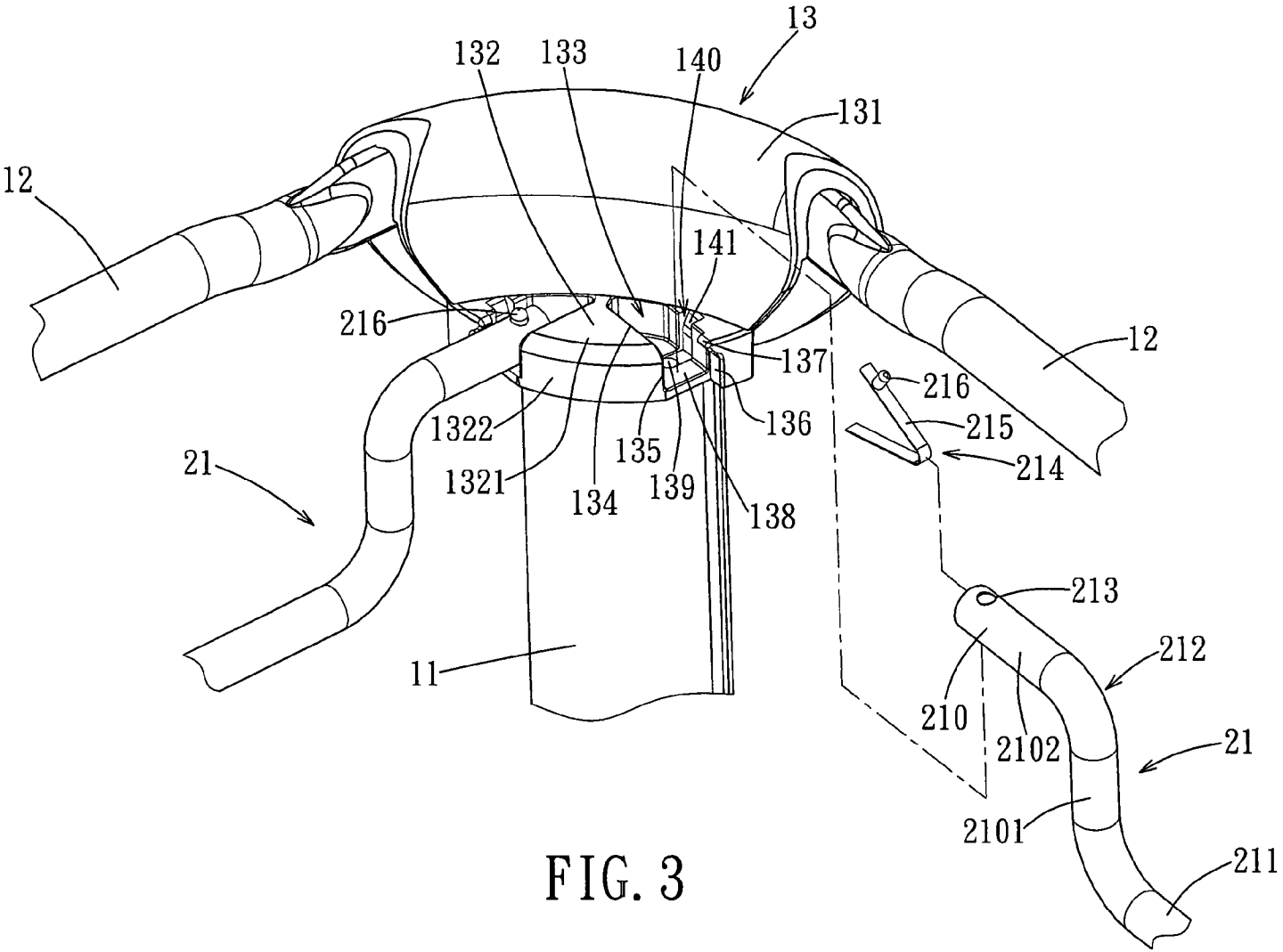
FIG. 3 is an enlarged fragmentary partly exploded perspective view of the first preferred embodiment.
Figure 4:
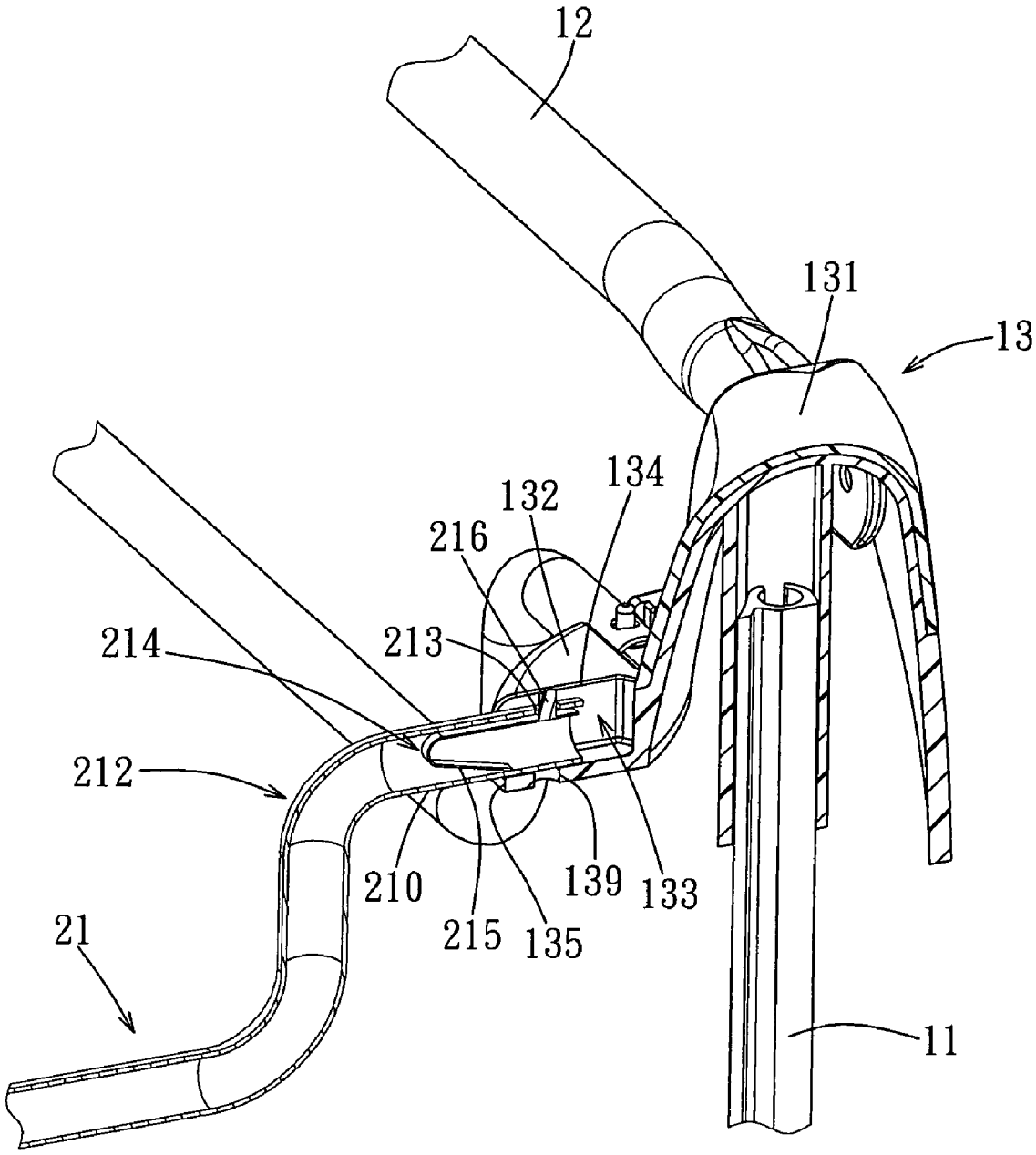
FIG. 4 is a fragmentary partly sectional perspective view of the first preferred embodiment taken along line 4-4 in FIG. 2, illustrating the second frame unit at the lower position.

Before the present invention is described in greater detail, it should be noted that like elements are denoted by the same reference numerals throughout the disclosure.

As shown in FIGS. 1 to 4, the first preferred embodiment of a play yard 100 according to the present invention comprises a first frame unit 1 and a second frame unit 2 adapted for supporting a bassinet (not shown) thereon.

The first frame unit 1 includes a plurality of spaced-apart upright rods 11, a plurality of corner couplers 13 that are provided respectively on top ends of the upright rods 11, and a plurality of side rods 12, each interconnecting an adjacent pair of the corner couplers 13. In this embodiment, each of the corner couplers 13 is connected pivotally to a corresponding pair of the side rods 12, and each of the side rods 12 has a foldable rod structure, such that the first frame unit 1 can be folded after use. In this embodiment, each of the upright rods 11 and the side rods 12 is a straight rod that can be replaced with a curved rod.

In this embodiment, each of the corner couplers 13 has a main body 131 coupled to the corresponding pair of the side rods 12 and a corresponding one of the upright rods 11, a coupling portion 132 projecting from the main body 131 and having a top surface 1321 and a lateral surface 1322 that extends downwardly from a periphery of the top surface 1321, and a pair of spaced-apart positioning slots 133 formed in the coupling portion 132 and disposed substantially perpendicular to each other. Each of the positioning slots 133 extends horizontally in the top surface 1321 of the coupling portion 132.

The second frame unit 2 includes a plurality of connecting rods 21. Each of the connecting rods 21 has a supporting segment 211, and a pair of bent end segments 212 that are connected respectively to longitudinally opposite ends of the supporting segment 211, and that are connected movably and respectively to an adjacent pair of the corner couplers 13. In this embodiment, each of the bent end segments 212 is L-shaped, and has a tubular body 210 having a first section

2101 that extends perpendicularly from the supporting segment 211, and a second section 2102 that extends from a distal end of the first section 2101. The second sections 2102 of the bent end segments 212 of each of the connecting rods 21 are aligned with each other. The first sections 2101 of the bent end segments 212 extend in the same direction. The second sections 2102 movably and respectively engage the corresponding positioning slots 133 in the adjacent pair of the corner couplers 13, i.e., the positioning slots 133 in each of the couplers 13 movably and respectively retain two corresponding ones of the second sections 2102. Each of the connecting rods 21 is selectively positioned relative to the first frame unit 1 at a lower position (see FIG. 1) and a higher position (see FIG. 6) located above the lower position. Preferably, Each of the connecting rods 21 is pivotable between the lower position and the higher position.

In this embodiment, each of the positioning slots 133 in the corner couplers 13 has a top opening 134 which is formed in the top surface 1321 of the coupling portion 132, and a lateral opening 135 which is formed in the lateral surface 1322 of the coupling portion 132, which is disposed in spatial communication with the top opening 134, and through which the second section 2102 rotatably extends.

Each of the positioning slots 133 in the corner couplers 13 is defined cooperatively by an internal side surface 136 which extends downwardly from the top surface 1321, and an internal bottom surface 138 which is connected to a bottom end of the internal side surface 136.

The internal side surface 136 is formed with a limiting block 137 protruding therefrom such that a groove width of a corresponding portion of the positioning slot 133 is smaller than a diameter of the second section 2102 so as to confine the second section 2102 between the limiting block 137 and the internal bottom surface 138.

Figure 5:
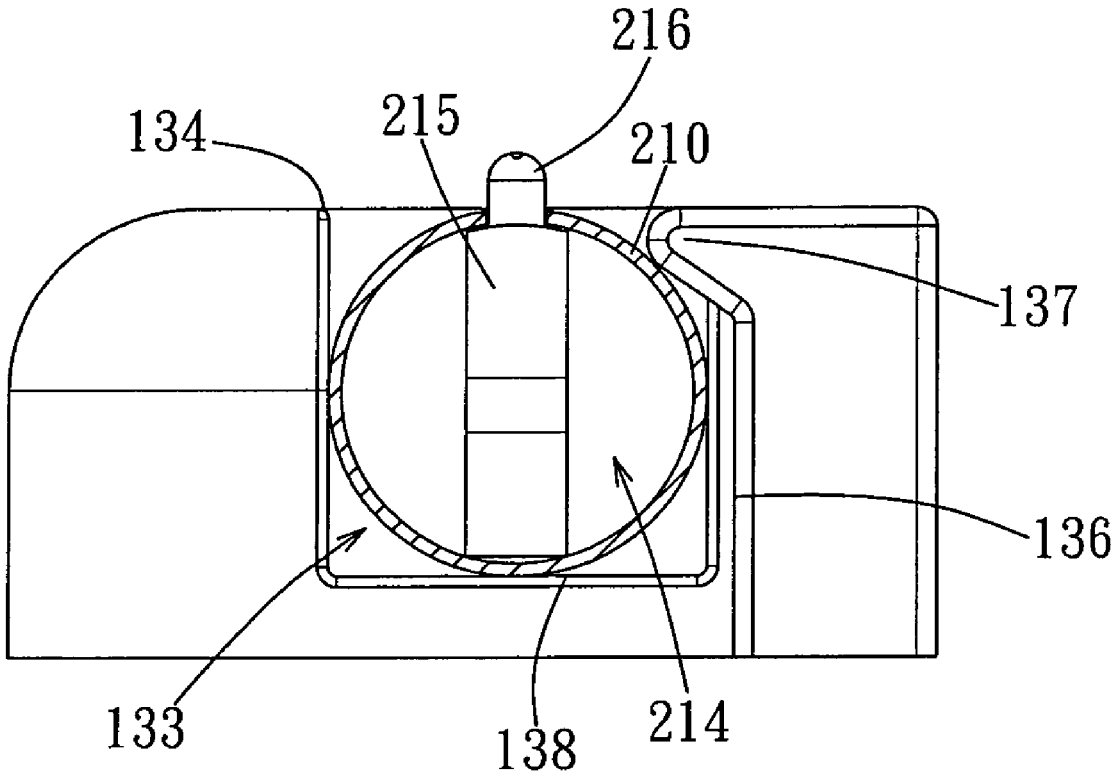
FIG. 5 is a sectional view of the first preferred embodiment taken along line 5-5 in FIG. 2.

Each of the internal bottom surfaces 138 of the corner couplers 13 is formed with a positioning hole 139. In this embodiment, each of the bent end segments 212 further has a through hole 213 formed in the second section 2102, and a positioning component 214 including a V-shaped resilient plate 215 that is disposed in the second section 2102, and a positioning protrusion 216 that is formed on the resilient plate 215. The positioning component 24 is biased to project outwardly from the tubular body 210 through the through hole 213 for positioning the resilient plate 215 in the tubular body 210, as shown in FIG. 5, and is disposed for engaging the positioning hole 139 in the internal bottom surface 138 when the corresponding one of the connecting rods 21 is at the higher position. Each of the corner couplers 13 further has a guide groove 140 formed in the internal bottom surface 138 and the internal side surface 136, extending from the positioning hole 139, and disposed for guiding movement of the positioning protrusion 216 into the positioning hole 139 when the corresponding one of the connecting rods 21 is pivoted from the lower position to the higher position.

Each of the corner couplers 13 further has an inclined guide surface 141 defining an upper end portion for facilitating insertion of the positioning protrusion 216 into the guide groove 140 when the corresponding one of the connecting rods 21 is pivoted from the lower position to the higher position.

Figure 6:
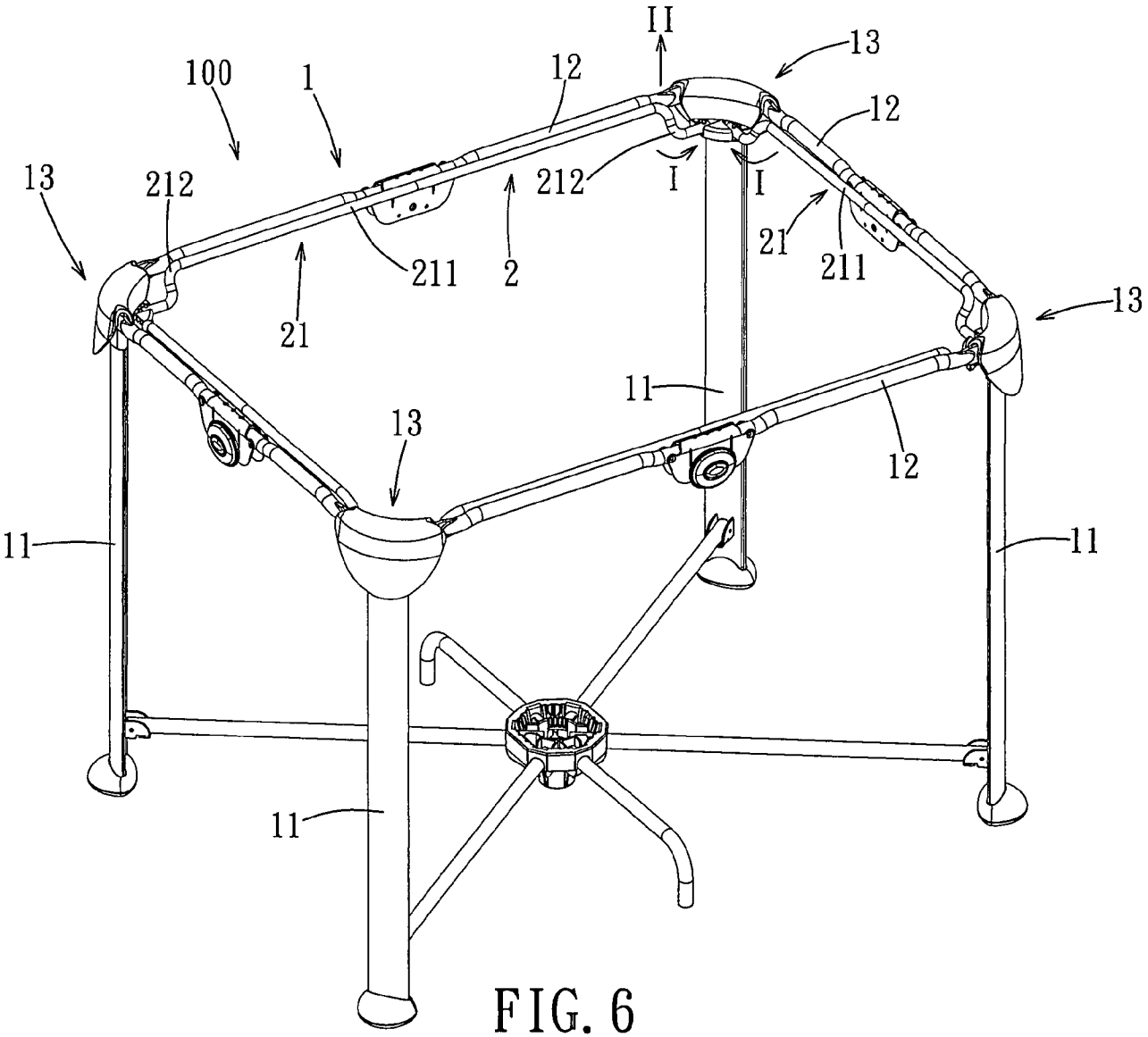
FIG. 6 is another perspective view of the first preferred embodiment, illustrating the second frame unit at a higher position.
Figure 7:
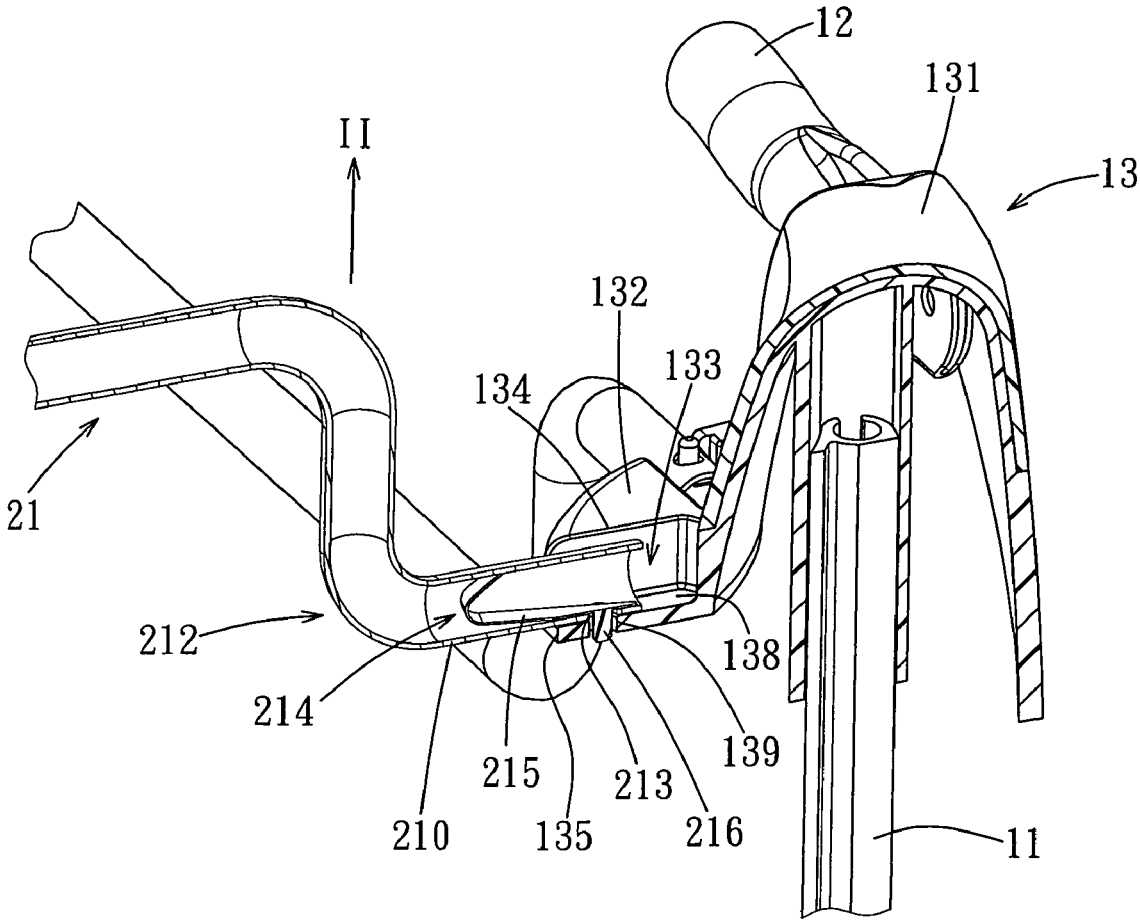
FIG. 7 is a view similar to FIG. 4, but illustrating the second frame unit at the higher position.

Referring once again to FIG. 1, when each of the connecting rods 21 of the second frame unit 2 is at the lower position, the supporting segments 211 of the connecting rods 21 are at positions lower than those of the side rods 12. As shown in FIGS. 2, 3, 6 and 7, when each of the connecting rods 21 is adjusted from the lower position to the higher position, it is rotated in a direction indicated by arrows (I) in FIG. 2, so that the positioning protrusion 216 of the positioning component 214 of each of the bent end segments 212 of the connecting rods 21 slides into the guide groove 140 via guidance of the guide surface 141. During rotation of one of the connecting rods 21, the positioning protrusion 216 slides along the guide groove 140, and is pushed by the internal side surface 136 and the internal bottom surface 138 to retract slightly into the tubular body 210. Referring to FIGS. 6 and 7, when rotated by 180 degrees, each of the connecting rods 21 is converted from the lower position to the higher position. At that time, the positioning protrusion 216 is moved to a position registered with the positioning hole 139, and is biased by a restoring force of the resilient plate 215 to extend outwardly of the tubular body 210 to engage the positioning hole 139, thereby positioning the corresponding one of the connecting rods 21 at the higher position.

Subsequently, each of the connecting rods 21 can be converted from the higher position back to the lower position by first exerting a pulling force in a direction indicated by arrows (II) in FIG. 7 upon each of the bent end segments 212 of the connecting rods 21. The pulling force has to be sufficient to overcome the confinement of the limiting block 137, so that the second section 2102 can be pulled out of the corresponding one of the positioning slots 133 through the top opening 134. Afterward, each of the connecting rods 21 is rotated by 180 degrees. Finally, the second section 2102 of each of the bent end segments 212 is inserted into and positioned within the corresponding one of the positioning slots 133 through the top opening 134, thereby completing the conversion. Therefore, each of the connecting rods 21 can be easily and quickly converted between the lower position and the higher position, thereby facilitating operation of the bassinet that is coupled to said second frame unit 2. It should be noted that, since each of the positioning holes 139 is formed through the coupling portion 132, a user can also push the positioning protrusion 216 upwardly so as to disengage the positioning protrusion 216 from the positioning hole 139, thereby permitting rotation of each of the connecting rods 21.

Figure 8:
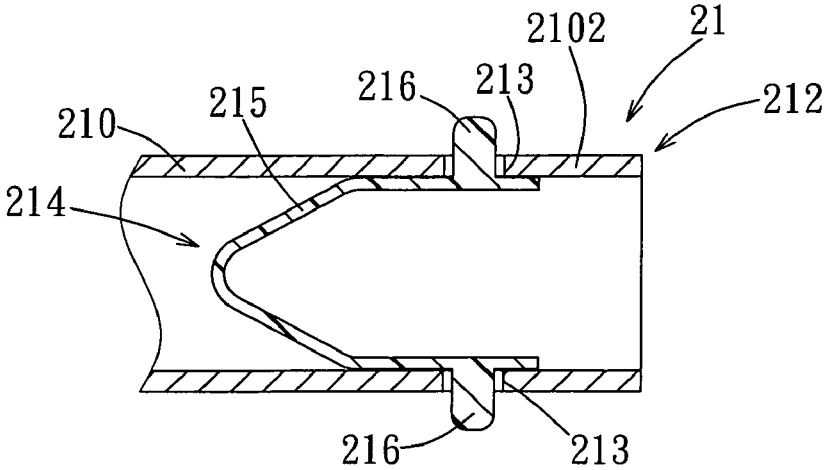
FIG. 8 is a fragmentary sectional view of a modified bent end segment of a connecting rod of the second frame unit.

It should be further noted that, referring to FIG. 8, each of the bent end segments 212 of the connecting rods 21 may have a pair of the through holes 213 formed respectively in diametrically opposite sides of the second section 2102, while the positioning component 214 may include a pair of the positioning protrusions 216 each formed on the resilient plate 215 and each biased to project outwardly and respectively from the tubular body 210 through the through holes 213 for positioning the resilient plate 215 in the tubular body 210. Moreover, the positioning component 214 may be in a form of a rigid body that is fixed on the tubular body 210. For example, the positioning component 214 of each of the bent end segments 212 may be formed integrally on the tubular body 210 in other embodiments of this invention.

Figure 9:
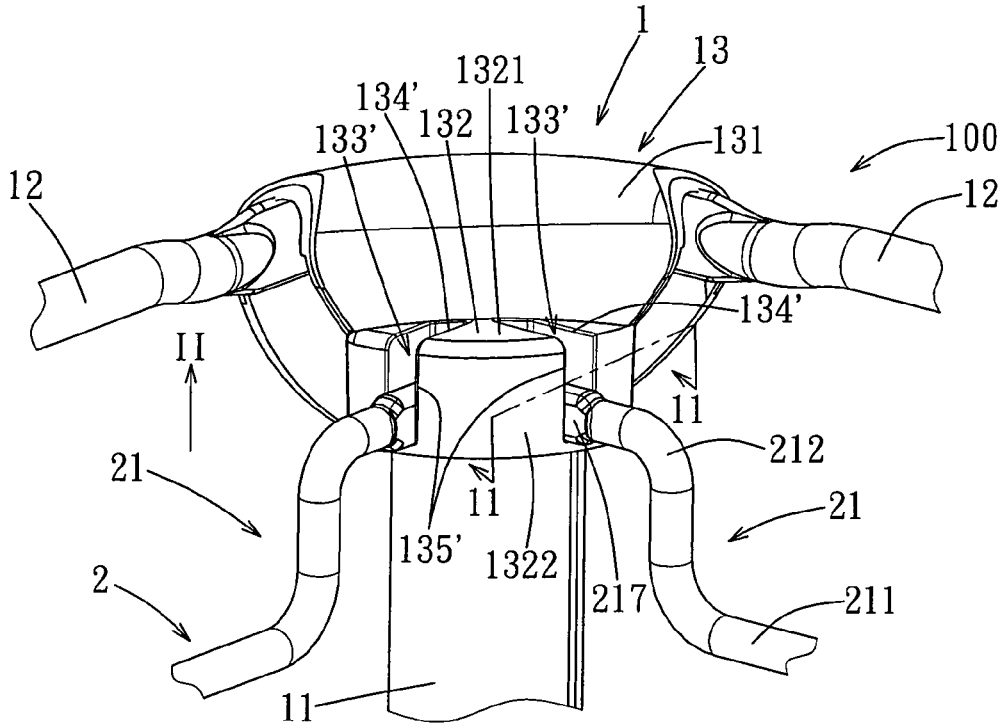
FIG. 9 is a fragmentary perspective view of a second preferred embodiment of the play yard according to the invention, illustrating a bassinet-supporting second frame unit at a lower position.
Figure 10:
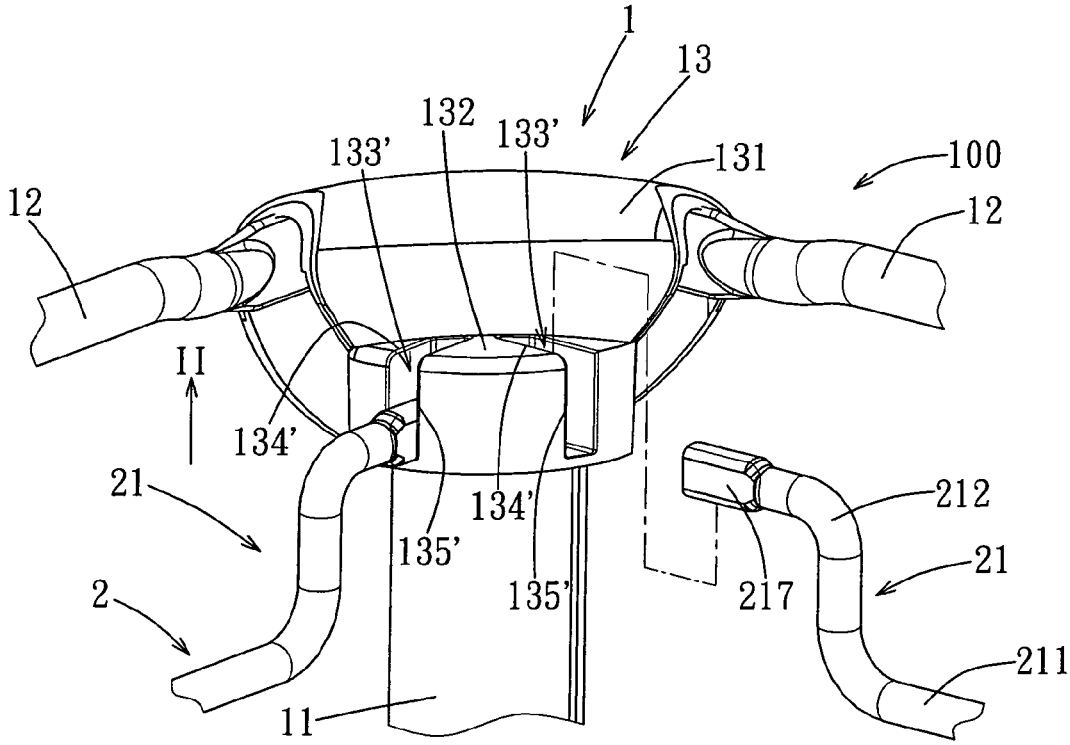
FIG. 10 is a fragmentary partly exploded perspective view of the second preferred embodiment.

As shown in FIGS. 9 to 10, the second preferred embodiment of the play yard 100 according to the present invention has a structure similar to that of the first embodiment. The main difference between this embodiment and the previous embodiment resides in the configurations of the corner couplers 13 of the first frame unit 1 and the bent end segments 212 of the connecting rods 21 of the second frame unit 2.

Figure 11:
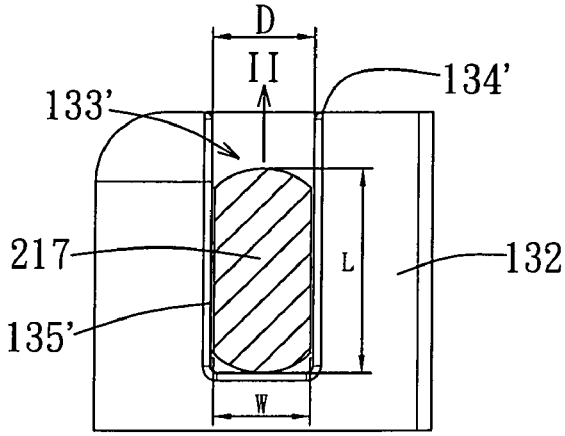
FIG. 11 is a sectional view of the second preferred embodiment taken along line 11-11 in FIG. 9.

Each of the corner couplers 13 has a main body 131 coupled to the corresponding pair of the side rods 12 and a corresponding one of the upright rods 11 of the first frame unit 1, a coupling portion 132 projecting from the main body 131 and having a top surface 1321 and a lateral surface 1322 that extends downwardly from a periphery of the top surface 1321, and a pair of spaced-apart positioning slots 133' formed in the coupling portion 132. With further reference to FIG. 11, each of the positioning slots 133' has a groove width (D), a top opening 134' formed in the top surface 1321 of the coupling portion 132, and a lateral opening 135' which is formed in the lateral surface 1322 of the coupling portion 132 and which is disposed in spatial communication with the top opening 134'. Each of the bent end segments 212 of the connecting rods 21 of the second frame unit 2 has a coupler-engaging portion 217 engaging removably a respective one of the positioning slots 133' in a respective one of the corner couplers 13. The coupler-engaging portion 217 has a rectangular cross-section that has a width (W) slightly shorter than the groove width (D) of the corresponding one of the positioning slots 133', and a height (L) longer than the groove width (D), such that misorientation of the coupler-engaging portion 217 can be avoided.

When each of the connecting rods 21 of the second frame unit 2 is at the lower position (see FIGS. 9 and 10), the coupler-engaging portion 217 of each of the bent end segments 212 of the connecting rods 21 extends into a corresponding one of the positioning slots 133' via the lateral opening 135'. Since the height (L) of the coupler-engaging portion 217 is longer than the groove width (D) of the corresponding one of the positioning slots 133', the coupler-engaging portion 217 is confined in the corresponding one of the positioning slots 133' and can not be rotated relative to the corresponding one of the corner couplers 13, i.e., each of the connecting rods 21 can be maintained at the lower position.

Figure 12:
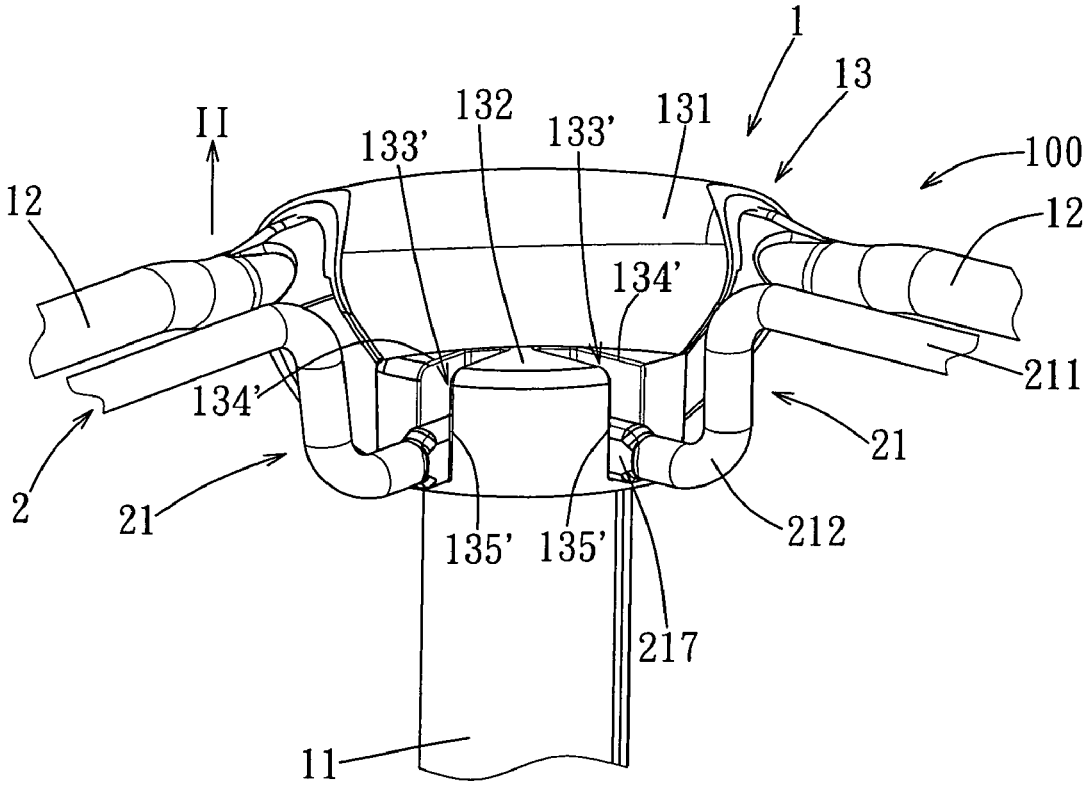
FIG. 12 is a view similar to FIG. 9, but illustrating the second frame unit at a higher position.

Each of the connecting rods 21 of the first frame unit 1 can be easily converted from the lower position (see FIGS. 9 and 10) to the higher position (see FIG. 12) by exerting a pulling force in a direction indicated by arrows (II) in FIGS. 9 to 11 so as to pull the coupler-engaging portion 217 out of the corresponding one of the positioning slots 133' from the top opening 134'. Afterward, each of the connecting rods 21 is rotated by 180 degrees. Finally, the coupler-engaging portion 217 is inserted into and positioned within the corresponding one of the positioning slots 133' through the top opening 134', thereby completing the conversion. The second preferred embodiment has the same advantages as the first preferred embodiment.

Figure 13:
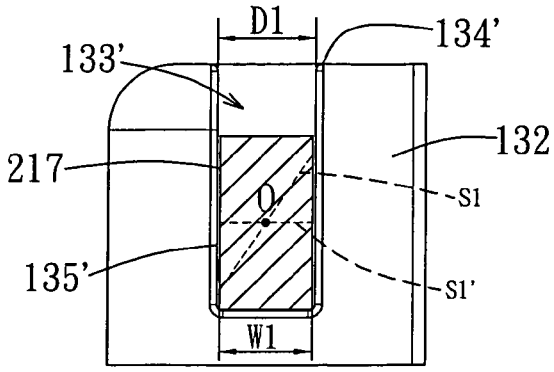
FIG. 13 is a cross-sectional view of a coupler-engaging portion of a bent end segment of a connecting rod of the second frame unit.
Figure 14:
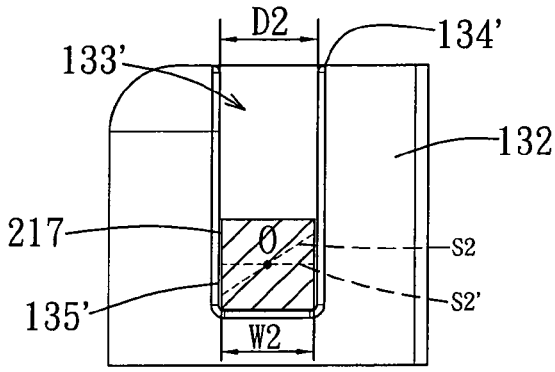
FIG. 14 is a cross-sectional view of a modified coupler-engaging portion of the bent end segment of the connecting rod of the second frame unit.
Figure 15:
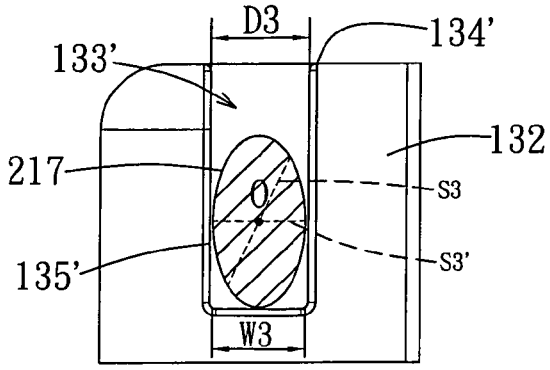
FIG. 15 is a cross-sectional view of another modified coupler-engaging portion of the bent end segment of the connecting rod of the second frame unit.

It should be noted that, while in this embodiment, the coupler-engaging portion 217 of each of the bent end segments 212 of the connecting rods 21 has the rectangular cross-section so as to be positioned relative to the corresponding one of the corner couplers 13, the shape of the cross-section of the coupler-engaging portion 217 should not be limited thereto. As shown in FIGS. 13 to 15, the shape of the cross-section of the coupler-engaging portion 217 may be rectangular, square, or elliptic as long as, there is at least one first imaginary straight line (S1, S2, S3) that extends across and within a cross-section of the coupler-engaging portion 217, that extends through a center (O) of the cross-section, and that has a length longer than the groove width (D1, D2, D3) of the corresponding one of the positioning slots 133' (slightly longer than the width (W1, W2, W3) of the cross-section of the coupler-engaging portion 217), and there is at least one second imaginary straight line (S1', S2', S3') that extends across and within the cross-section of the coupler-engaging portion 217, that intersects the first imaginary straight line (S1, S2, S3) at the center (O) of the cross-section, and that has a length shorter than the groove width (D1, D2, D3) of the corresponding one of the positioning slots 133'.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A play yard comprising:

a first frame unit including a plurality of spaced-apart upright rods, a plurality of corner couplers that are provided respectively on said upright rods, and a plurality of side rods, each interconnecting a pair of said corner couplers; and a bassinet-supporting second frame unit including a plurality of connecting rods, each having a supporting segment, and a pair of bent end segments that are connected respectively to longitudinally opposite ends of said supporting segment, and that are connected movably and respectively to a pair of said corner couplers, such that each of said connecting rods is selectively positioned at a lower position and a higher position located above the lower position relative to said first frame unit, wherein each of said corner couplers has a pair of spaced-apart positioning slots movably and respectively retaining two corresponding ones of said bent end segments of an adjacent pair of said connecting rods of said second frame unit.

2. The play yard as claimed in claim 1, wherein said positioning slots in each of said corner couplers are substantially perpendicular to each other.

3. The play and as claimed in claim 2, wherein:

each of said corner couplers further has a tap surface and a lateral surface that extends downwardly from a periphery of said top surface; and each of said positioning slots in said corner couplers extends horizontally in said top surface, has an opening formed at said lateral surface and through which a corresponding one of said bent end segments rotatably extends, and is defined cooperatively by an internal side surface which extends downwardly from said top surface, and an internal bottom surface which is connected to a bottom end of said internal side surface, said internal side surface being formed with a limiting block protruding therefrom such that a groove width of a corresponding portion of said positioning slot is smaller than a diameter of the corresponding one of said bent end segments so as to confine the corresponding one of said bent end segments between said limiting block and said internal bottom surface.

4. The play yard as claimed in claim 3, wherein:

each of said internal bottom surfaces of said corner couplers of said first frame unit is formed worth a positioning hole; and each of said bent end segments of said connecting rods of said second frame unit has a positioning component for engaging said positioning hole when a corresponding one of said connecting rods is at the higher position.

5. The play yard as claimed in claim 4, wherein said positioning component of each of said bent end segments is in a form of a rigid body.

6. The play yard as claimed in claim 4, wherein:

each of said bent end segments of said connecting rods further has a tubular body and a through hole formed in said tubular body; and said positioning component of each of said bent end segments has a resilient plate disposed in said tubular body, and a positioning protrusion formed on said resilient plate and biased to project outwardly from said tubular body through said through hole in said tubular body of a corresponding one of said bent end segments for positioning said resilient plate in said tubular body of the corresponding one of said bent end segments, said positioning protrusion being disposed for engaging said positioning hole in said internal bottom surface of the corresponding one of said corner couplers when the corresponding one of said connecting rods is at the higher position.

7. The play yard as claimed in claim 6, wherein said resilient plate is a V-shaped plate.

8. The play yard as claimed in claim 6, wherein each of said corner couplers further has a guide groove formed in said internal bottom surface and said internal side surface for guiding movement of said positioning protrusion of the corresponding one of said bent end segments into said positioning hole in said internal bottom surface of the corresponding one of said corner couplers when the corresponding one of said connecting rods is pivoted cram the lower position to the higher position.

9. The play yard as claimed in claim 4, wherein:

each of said bent end segments further has a tubular body and a pair of through holes formed respectively in diametrically opposite sides of said tubular body; and said positioning component of each of said bent end segments has a resilient plate disposed in said tubular body, and a pair of positioning protrusions formed on said resilient plate and biased to project outwardly and respectively from said tubular body through said through holes for positioning said resilient plate in said tubular body.

10. The play yard as claimed in claim 1, wherein:

each of said bent end segments has a coupler-engaging, portion; and a first imaginary straight line extending across and within a cross-section of said coupler-engaging portion and through a center of the cross-section, the first imaginary straight line having a length longer than a groove width of said positioning slot in a corresponding one of said corner couplers.

11. The play yard as claimed in claim 10, wherein a second imaginary straight line extends across and within the cross-section of said coupler-engaging portion of each of said bent end segments, and intersects the first imaginary straight line at the center of the cross-section, the second imaginary straight line having a length shorter than the groove width of said positioning slot.

12. The play yard as claimed in claim 10, wherein said coupler-engaging portion of each of said bent end segments has a rectangular cross-section that has a width slightly shorter than the groove width of said positioning slot on the corresponding one of said corner couplers.

13. The play yard as claimed in claim 10, wherein said coupler-engaging portion of each of said bent end segments has an elliptic cross-section.

14. A bassinet device adapted for use with a play yard, the play yard including a first frame unit that has a plurality of spaced-apart upright rods, a plurality of corner couplers provided respectively on said upright rods, and a plurality of side rods, each interconnecting a pair of said corner couplers, said bassinet device comprising:

a bassinet-supporting second frame unit including a plurality of connecting rods, each having a supporting segment, and a pair of bent end segments that are connected respectively to longitudinally opposite ends of said supporting segment, and that are adapted to be connected movably and respectively to a pair of the corner couplers, such that each of said connecting rods is selectively positioned relative to the first frame unit at a lower position and a higher position located above the lower position; and wherein each of said corner couplers has a pair of spaced-apart positioning slots movably and respectively retaining two corresponding ones of said bent end segments of an adjacent pair of said connecting rods.

* * * * *